US010549172B2

(12) United States Patent
Bittner

(10) Patent No.: US 10,549,172 B2
(45) Date of Patent: Feb. 4, 2020

(54) SENSOR FOR IMPROVING AND TRAINING PUTTING TECHNIQUE

(71) Applicant: Norman Douglas Bittner, Charlotte, NC (US)

(72) Inventor: Norman Douglas Bittner, Charlotte, NC (US)

( * ) Notice: Subject to any disclaimer, the term of this patent is extended or adjusted under 35 U.S.C. 154(b) by 0 days.

(21) Appl. No.: 15/864,453

(22) Filed: Jan. 8, 2018

(65) Prior Publication Data

US 2018/0193714 A1 Jul. 12, 2018

Related U.S. Application Data

(60) Provisional application No. 62/443,379, filed on Jan. 6, 2017.

(51) Int. Cl.
*A63B 69/36* (2006.01)
*A63B 71/06* (2006.01)

(52) U.S. Cl.
CPC .. *A63B 69/3685* (2013.01); *A63B 2071/0647* (2013.01); *A63B 2220/30* (2013.01); *A63B 2220/803* (2013.01); *A63B 2220/833* (2013.01)

(58) Field of Classification Search
None
See application file for complete search history.

(56) References Cited

U.S. PATENT DOCUMENTS

| | | | | |
|---|---|---|---|---|
| 5,441,269 | A * | 8/1995 | Henwood | A63B 69/3685 473/220 |
| 6,607,450 | B1 * | 8/2003 | Hackman | A63B 69/3632 473/223 |
| 7,806,780 | B1 * | 10/2010 | Plunkett | A63B 69/3641 473/229 |
| 7,871,333 | B1 * | 1/2011 | Davenport | A63B 57/00 473/223 |
| 7,955,180 | B2 | 6/2011 | Bittner | |
| 8,002,643 | B2 | 8/2011 | Bittner | |
| 8,047,928 | B2 | 11/2011 | Bittner | |
| 8,152,649 | B2 | 4/2012 | Bittner | |
| 8,177,656 | B2 | 5/2012 | Bittner | |
| 8,337,321 | B2 | 12/2012 | Bittner | |
| 8,579,720 | B2 | 11/2013 | Bittner | |
| 8,616,993 | B2 | 12/2013 | Bittner | |
| 8,727,903 | B2 | 5/2014 | Bittner | |
| 9,022,877 | B2 | 5/2015 | Bittner | |
| 9,174,110 | B2 | 11/2015 | Bittner | |
| 9,707,465 | B2 | 7/2017 | Bittner | |
| 10,092,811 | B2 * | 10/2018 | Kim | A63B 69/3614 |
| 2002/0123386 | A1 * | 9/2002 | Perlmutter | A63B 24/0021 473/223 |
| 2002/0173365 | A1 * | 11/2002 | Boscha | A63B 69/3617 473/131 |
| 2008/0200275 | A1 * | 8/2008 | Wagen | A63B 69/3685 473/234 |

(Continued)

*Primary Examiner* — Tramar Y Harper
(74) *Attorney, Agent, or Firm* — Nixon & Vanderhye P.C.

(57) ABSTRACT

A putting stroke sensor is attachable to a putter head for measuring characteristics of a putting stroke. A motion sensor integrated circuit is configured to measure acceleration of the putter head along several axes and rotation of the putter head around the several axes during a putting stroke. A processor is programmed to determine a speed, a position and an orientation of the putter head at selective intervals during the putting stroke.

19 Claims, 6 Drawing Sheets

(56) References Cited

U.S. PATENT DOCUMENTS

| | | | | |
|---|---|---|---|---|
| 2009/0137333 | A1* | 5/2009 | Lin | A63B 53/14 473/233 |
| 2009/0163285 | A1* | 6/2009 | Kwon | A63B 24/0021 473/223 |
| 2010/0222152 | A1* | 9/2010 | Jaekel | A63B 69/3617 473/223 |
| 2012/0277016 | A1* | 11/2012 | Boyd | A63B 24/0003 473/223 |
| 2013/0079171 | A1* | 3/2013 | Bittner | A63B 69/3614 473/222 |
| 2013/0252751 | A1* | 9/2013 | Bittner | A63B 69/3614 473/220 |
| 2016/0038817 | A1* | 2/2016 | Bittner | A63B 69/3676 473/229 |

* cited by examiner

SENSOR FOR IMPROVING AND TRAINING PUTTING TECHNIQUE

CROSS-REFERENCES TO RELATED APPLICATIONS

This application claims the benefit of U.S. Provisional Patent Application No. 62/443,379, filed Jan. 6, 2017, the entire content of which is herein incorporated by reference.

STATEMENT REGARDING FEDERALLY SPONSORED RESEARCH OR DEVELOPMENT (Not Applicable)

BACKGROUND

The invention relates to a system for improving and training putting technique and, more particularly, to a sensor that is attachable to a putter head that measures characteristics of a putting stroke to assist in improving and training putting technique.

Existing putting trainers and similar devices typically endeavor to train users in squaring the putter head clubface relative to the target at impact with the golf ball. Existing systems, however, typically predefine a "correct" putting stroke. The Applicant in the present application, however, has documented multiple successful putting strokes that enable golfers to square the club face at impact, but these successful putting strokes vary widely by player, especially amateur golfers. It has been discovered that each golfer in fact has a unique "preferred putting stroke" that can achieve a successful result.

BRIEF SUMMARY

It would thus be desirable for a system to identify each player's preferred stroke and to provide a vehicle to assist that player in practicing and perfecting his or her unique preferred putting stroke.

The applicant has developed systems and methods for identifying a player's specific preferred putting stroke and for training a golfer to more consistently execute his or her preferred putting stroke. Exemplary devices are described in U.S. Pat. No. 9,707,465—Robotic putting system, U.S. Pat. No. 9,174,110—Robotic putting system, U.S. Pat. No. 9,022,877—Putting stroke training system, U.S. Pat. No. 8,727,903—Putting stroke training system, U.S. Pat. No. 8,616,993—Putter path detection and analysis, U.S. Pat. No. 8,579,720—Putting stroke training system, U.S. Pat. No. 8,337,321—Putting stroke training system, U.S. Pat. No. 8,177,656—Putter training system, U.S. Pat. No. 8,152,649—Golf putter and grid for training a golf putting method, U.S. Pat. No. 8,047,928—Putter training system, U.S. Pat. No. 8,002,643—Golf putter and grid for training a golf putting method, and U.S. Pat. No. 7,955,180—Golf putter with aiming apparatus, the contents of all of which are hereby incorporated by reference.

In the described embodiments, an electronic sensor is attachable to a putter head for detecting and calculating characteristics of a putting stroke at specified intervals. The sensor can be used for training or during play with instant feedback using the on board LED display and/or a mobile application cooperable with the sensor. Additionally, the sensor may be used to determine a player's unique preferred putting stroke. The preferred putting stroke may also be stored in the sensor through the use of a robotic putting arm described in the patents incorporated by reference above.

In an exemplary embodiment, a putting stroke sensor attachable to putter head includes a memory storing an executable program and a processor configured to execute the program. A motion sensor integrated circuit communicating with the processor is configured to measure acceleration of the putter head along X, Y and Z axes and rotation of the putter head around the X, Y and Z axes during a putting stroke. By executing the program, the processor is programmed to determine a speed, a position and an orientation of the putter head at selective intervals during the putting stroke.

The processor may be programmed to compare the speed, the position and the orientation of the putter head at the selective intervals during the putting stroke with corresponding characteristics at corresponding intervals of a preferred putting stroke. The sensor may additionally include feedback LEDs that may be driven by the processor to display deviations in the position, speed and/or rotation with the corresponding characteristics of the preferred putting stroke. A wireless transmission integrated circuit may be configured to communicate the measured acceleration and rotation to a mobile device. In some embodiments, the mobile device may store a mobile application, and the processor may be resident in the mobile device.

The motion sensor integrated circuit may be further configured to measure changes in magnetic fields on at least two axes relative to Earth. In this context, the motion sensor integrated circuit may be a 2-axis magnetometer.

In some embodiments, the processor may be programmed to operate in a learning mode upon execution of the program. In the learning mode, the processor stores the speed, the position and the orientation of the putter head at the selective intervals during a successful putting stroke. The sensor may also include a user input device that may be actuated to signify the successful putting stroke. The processor may be programmed to collect the speed, the position and the orientation of the putter head at the selective intervals for a plurality of the successful putting strokes, and the processor may be programmed to calculate a preferred putting stroke based on average characteristics of the plurality of successful putting strokes. The sensor may include a robotic putting arm that guides the putter head along the preferred putting stroke.

In another exemplary embodiment, a putting stroke sensor attachable to putter head includes a memory storing an executable program and a processor configured to execute the program. A motion sensor integrated circuit communicating with the processor includes an accelerometer configured to measure acceleration of the putter head along X, Y and Z axes during a putting stroke and a gyroscope configured to measure rotation of the putter head around the X, Y and Z axes during the putting stroke. By executing the program, the processor is programmed to determine a speed, a position and an orientation of the putter head at selective intervals during the putting stroke. The processor is programmed to compare the speed, the position and the orientation of the putter head at the selective intervals during the putting stroke with corresponding characteristics at corresponding intervals of a preferred putting stroke. The processor is programmed to display deviations in the position, speed and/or rotation with the corresponding characteristics of the preferred putting stroke.

In still another exemplary embodiment, a putting training method using a putting stroke sensor attached to a putter head includes the steps of (a) measuring, with a motion sensor, acceleration of the putter head along at least two axes and rotation of the putter head around the at least two axes during a putting stroke; (b) determining a speed, a position and an orientation of the putter head at selective intervals during the putting stroke; and (c) comparing the speed, the position and the orientation of the putter head at the selective intervals during the putting stroke with corresponding characteristics at corresponding intervals of a preferred putting stroke. In a learning mode, the method may further include storing the speed, the position and the orientation of the putter head at the selective intervals during a successful putting stroke. Prior to step (a), the method may include collecting the speed, the position and the orientation of the putter head at the selective intervals for a plurality of the successful putting strokes, and calculating the preferred putting stroke based on average characteristics of the plurality of successful putting strokes. The method may also include securing the putting stroke sensor to a robotic putting arm that guides the putter head along the preferred putting stroke, and storing the speed, the position and the orientation of the putter head at the selective intervals of the preferred putting stroke.

BRIEF DESCRIPTION OF THE DRAWINGS

These and other aspects and advantages will be described in detail with reference to the accompanying drawings, in which.

DETAILED DESCRIPTION

Figure 1:
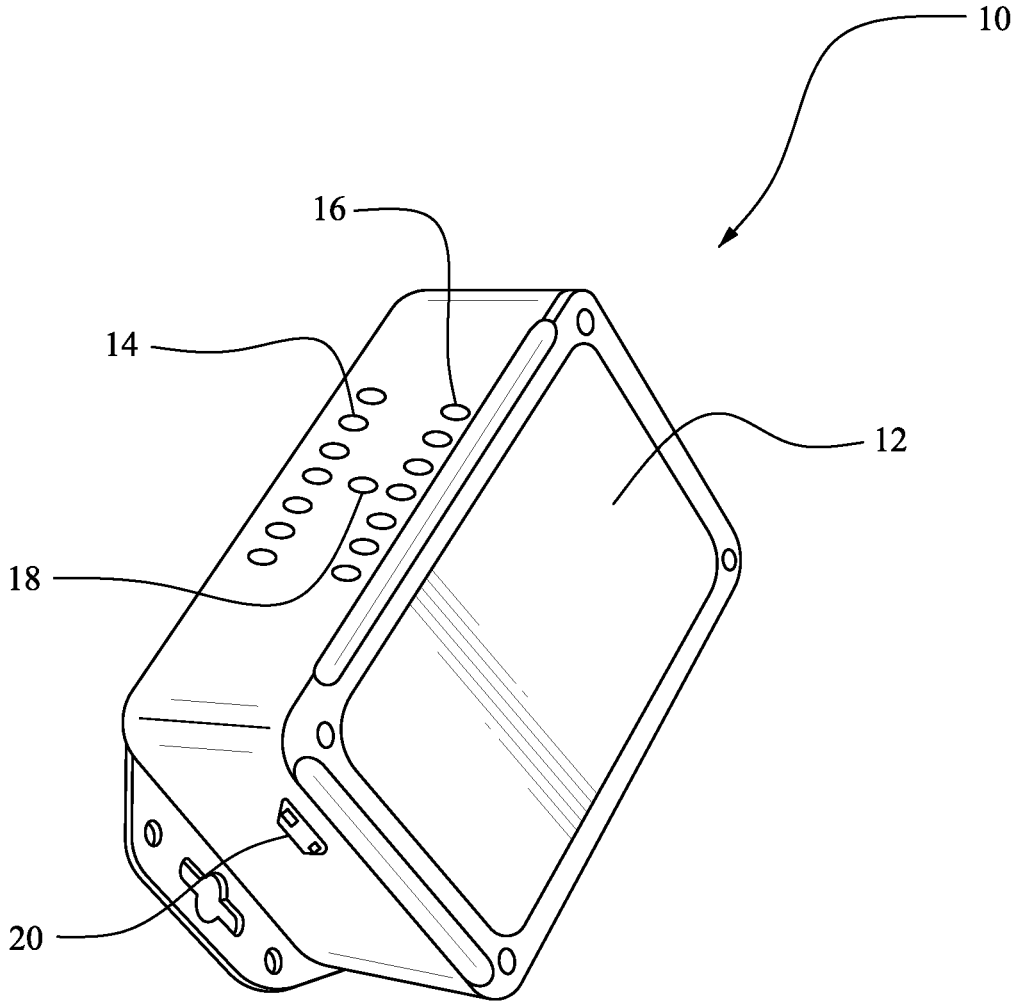
FIG. 1 is a perspective view of an exemplary sensor according to the described embodiments.
Figure 2:
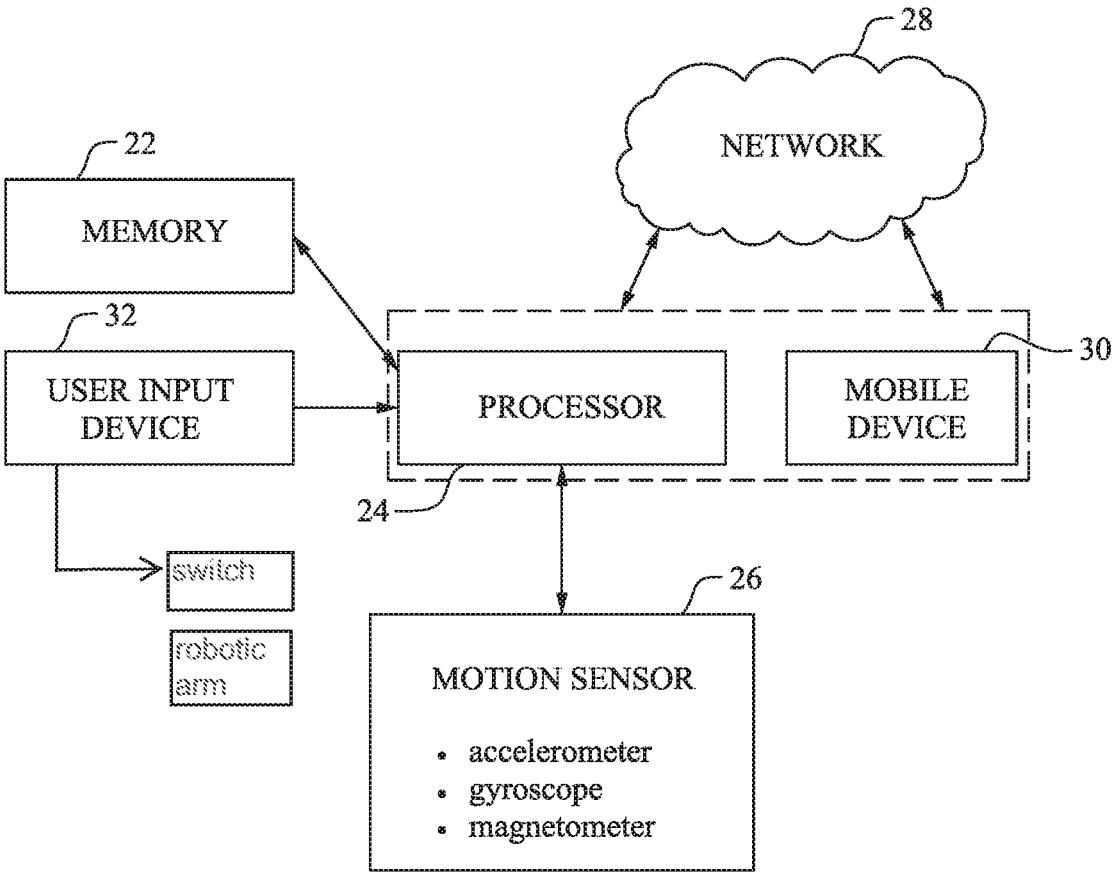
FIG. 2 is a schematic illustration of the sensor and sensor components.
Figure 3:
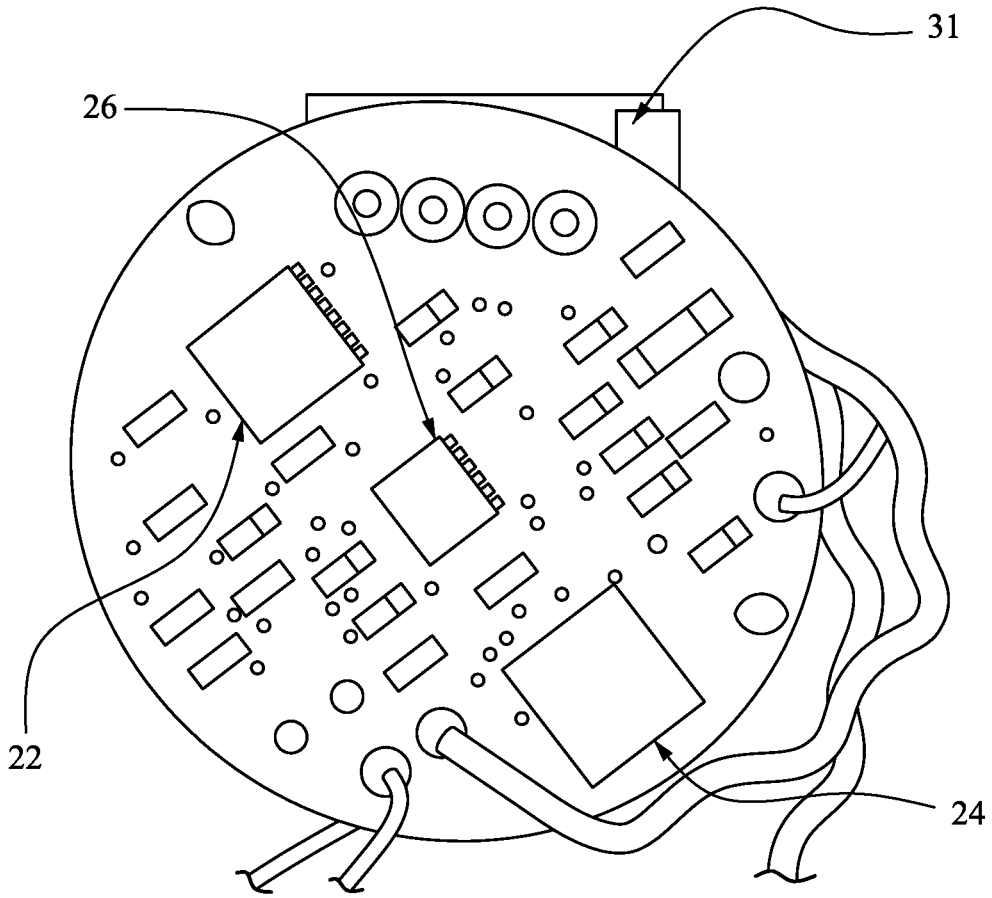
FIG. 3 shows an exemplary circuit board of the described sensor.

With reference to FIGS. 1-3, the sensor 10 includes a plurality of electrical components disposed in a housing 12. The housing 12 is provided with feedback LEDs including, for example, position error LEDs 14 and angular error LEDs 16. The housing 12 also includes a power LED 18 to indicate that the device is powered on. A connector port 20 such as a micro USB port or the like may be used for accessing the internal microprocessor and/or for charging the device battery.

Within the housing 12 is disposed a dedicated printed circuit board. The sensor components are connected to one another and cooperable via the printed circuit board. A memory 22 stores an executable program as well as swing data. A microprocessor 24 communicates with the memory 22 and is configured to execute the program. A motion sensor or motion sensor integrated circuit 26 is configured to measure acceleration of the device to which it is attached (e.g., a putter head according to the described embodiments) along X, Y and Z axes and rotation of the putter head around X, Y and Z axes during a putting stroke. In some embodiments, the motion sensor 26 is configured to measure changes in magnetic fields on at least two axes relative to Earth. In a preferred construction, the motion sensor 26 may include a 3-axis accelerometer, a 3-axis gyroscope, and a 2-axis magnetometer. The combination of the accelerometer and gyroscope effectively create an inertial measurement unit (IMU), which provides two to six degrees of freedom.

The sensor may also include a wireless transmission integrated circuit or network 28. The circuit 28 may connect to a mobile or smart device 30 via Bluetooth, Wi-Fi or the like. In some embodiments, the wireless network integrated sensor 28 is a Wi-Fi radio that creates a local Wi-Fi network. The mobile device 30 can connect to the local Wi-Fi network to receive and/or process data measured by the motion sensor 26. In some embodiments, the sensor 10 collects the swing data and transmits the data to the mobile device 30 using the wireless transmission circuit 28. The data from the sensor may be processed in the mobile device 30 and transmitted back to the sensor via the network 28. The processor 24 displays the results of the processed data on the housing 12 via the feedback LEDs 14, 16.

The sensor is also provided with a battery 31 such as a compact lithium ion battery to power the unit as well as an on/off switch (not shown).

The mobile device 30 stores a mobile application or "app" that receives and analyzes data from the motion sensor 26. In some embodiments, as shown in dashed line in FIG. 2, the processor 24 may be resident as part of the device 30. In this context, the sensor 10 may be configured to deliver the raw motion sensor data to the mobile device 30 via the network 28, and all processing of the data may be performed by the mobile device 30. Alternatively, the processor 24 in the sensor housing 12 may itself process the data from the motion sensor 26 to output the stroke characteristics.

The sensor assembly may additionally include a user input device 32 usable in a learning mode (described in more detail below). The user input device 32 may be a user-operated switch that is actuated to signify a successful putting stroke. Alternatively, the user input device 32 may be a robotic putting arm that guides the putter head along the preferred putting stroke.

The sensor 10 uses highly sophisticated electronics along with very advanced sensor technology. The sensor collects the data from the swing of a putter at very high data rate and transmits the data to the smart device 30 for further processing using highly complicated math functions. The math associated with these calculations is described in an article entitled "Polynomial Regression," appended to the above-referenced provisional application. The contents of the article are hereby incorporated by reference. See also, "An efficient orientation filter for inertial and inertial/magnetic sensor arrays," Apr. 30, 2010, authored by Sebastian O. H. Madgwick, and "Projectile dynamics in sport, principles and applications," authored by Colin White, the contents of both of which are hereby incorporated by reference. Subsequently, past processing data is compared with stored putter swing data to generate the final output, which is displayed on the sensor 10 by means of the feedback LEDs 14, 16.

Figure 4A:
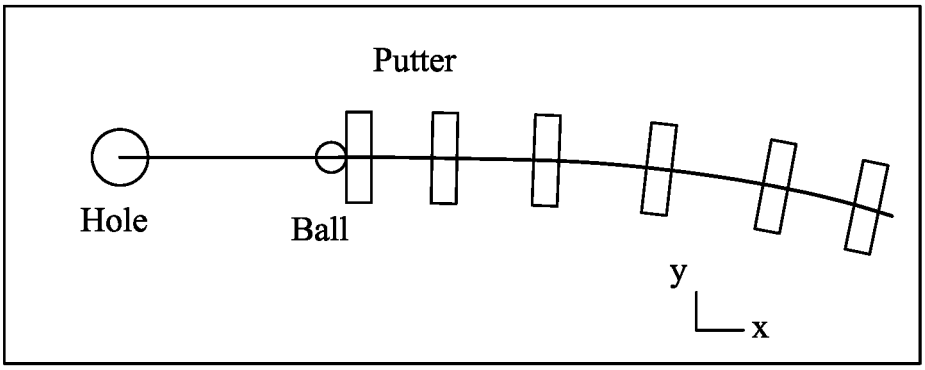
FIGS. 4A-4C show plan views of exemplary putting strokes.
Figure 4B:
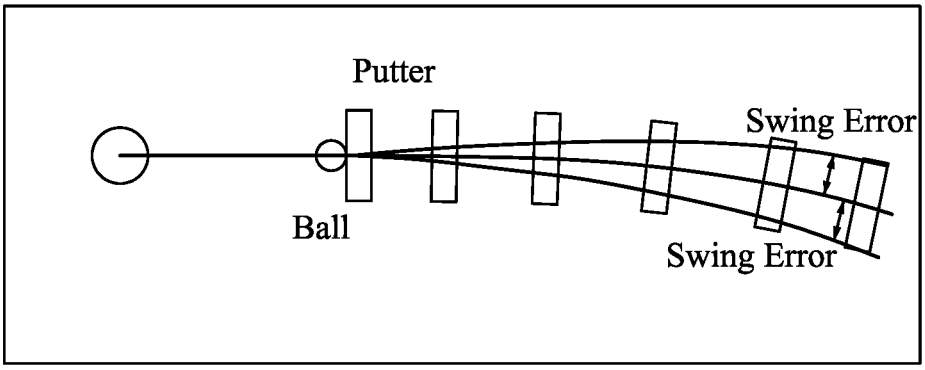
Figure 4C:
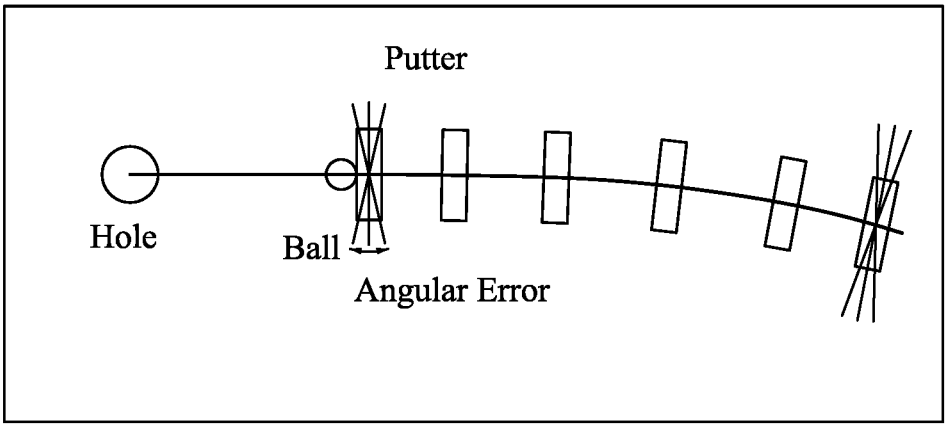

FIGS. 4A-4C show exemplary variations in a putting stroke. FIG. 4A is an exemplary preferred putting stroke. The X and Y axes are shown. The Z axis is vertical through the page in FIG. 4A. FIG. 4B shows variations in Y axis position from the preferred putting stroke that may be displayed on feedback LED 14, and FIG. 4C shows angular variations around the Z axis that may be displayed on feedback LED 16. The sensor 10 also monitors position data relative to the Z axis (i.e., the height of the putter at various intervals during the putting stroke).

In one embodiment, the sensor 10 includes a Smart Arm Microprocessor with communication components that enable wireless data transmission.

Software Task:

1) swing detection, data collection, filtering and averaging, data transmission using wireless to smart device;

2) data processing and result compression with the player preferred putting stroke stored during calibration;

3) error computation and transmitting to sensor; and 4) result indication using LEDs.

Figure 5:
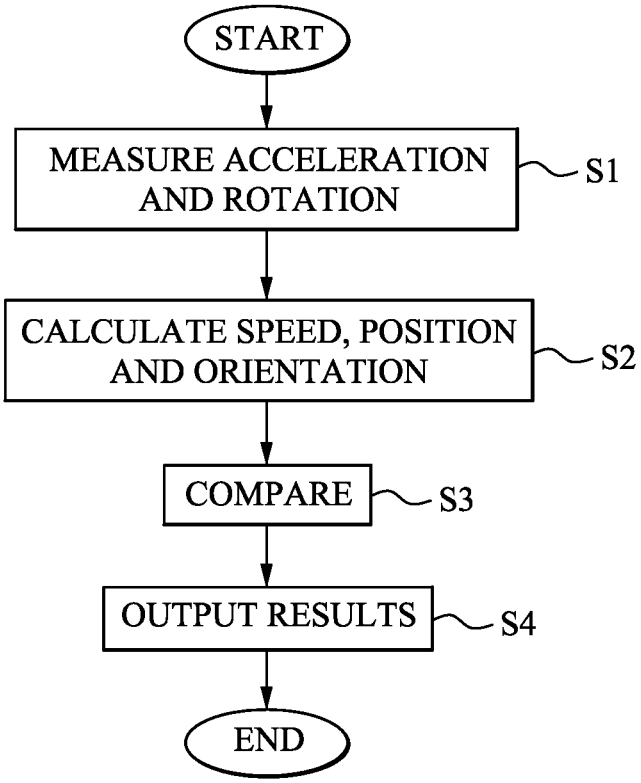
FIG. 5 is a flow diagram of an exemplary use application.

FIG. 5 is an exemplary flowchart showing use and operation of the sensor according to the described embodiments. When the unit is turned on, as a putting stroke begins, the sensor measures acceleration and rotation and possibly changes in magnetic fields of the putter head to which the sensor is attached at selective intervals during the putting stroke (step S1). As would be apparent to those of ordinary skill in the art, using the data measured by the motion sensor 26, the processor 24 can subsequently calculate with mathematical formulae speed, position and orientation (step S2) at the selective intervals during the putting stroke. For example, using calculus principles and polynomial regression, speed and position can be determined from acceleration, and orientation can be determined using various detected components including, for example, data measured by the 2-axis magnetometer. In step S3, the processor compares the speed, position and orientation of the putter head at the selective intervals during the putting stroke with corresponding characteristics at corresponding intervals of the preferred putting stroke stored in the memory 22. The processor 24 subsequently drives the feedback LEDs 14, 16 to display deviations in the position, speed and/or orientation with the corresponding characteristics of the preferred putting stroke (step S4).

Figure 6:
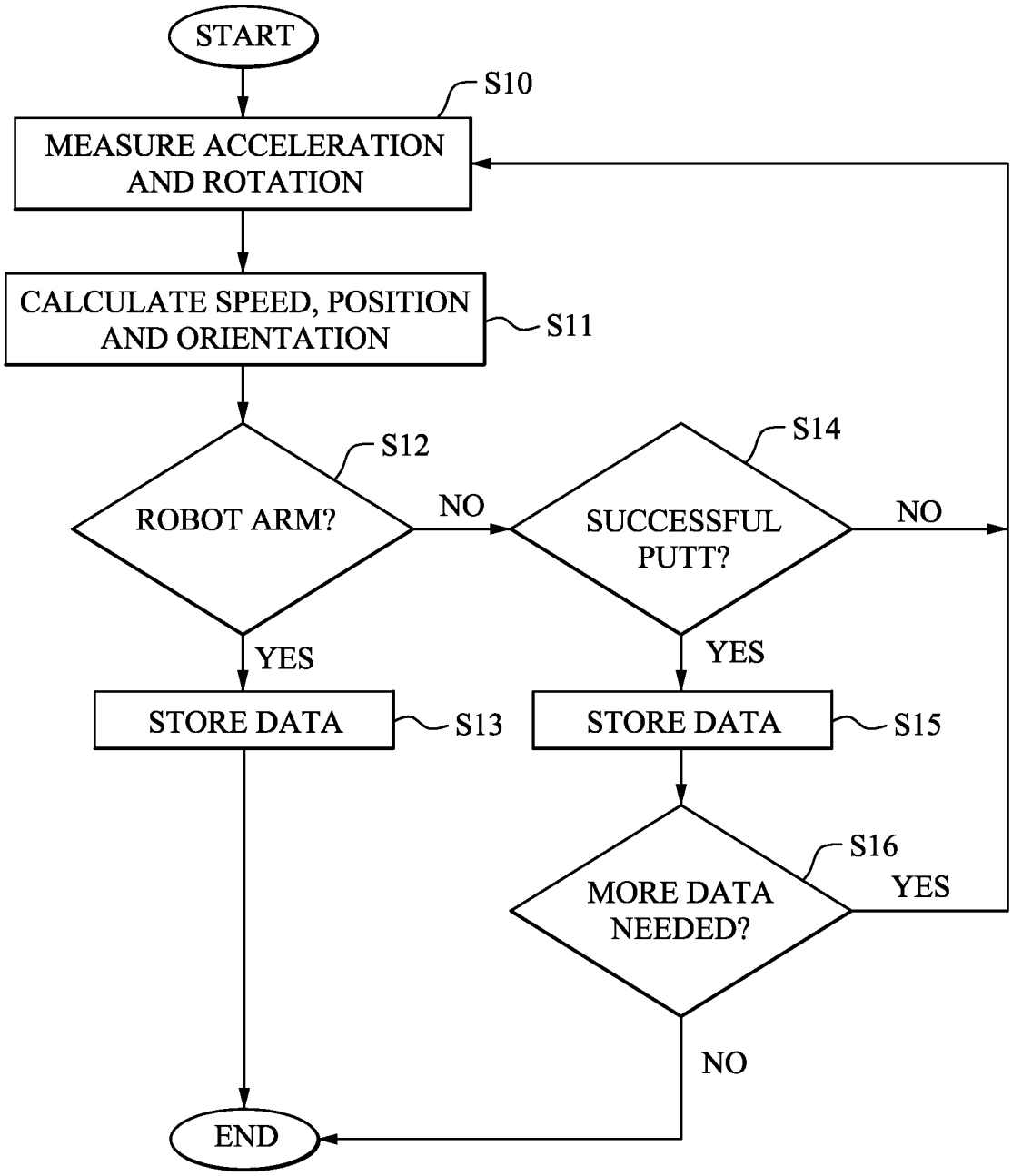
FIG. 6 is a flow diagram of an exemplary use application with the sensor in a learning mode.

The sensor is also operable in a learning mode in order to determine and store the particular user's unique preferred putting stroke. FIG. 6 is a flow diagram showing an exemplary process performed in the learning mode. The user may activate the learning mode via the mobile app and/or via a switch on the sensor. When the learning mode is activated, the sensor measures acceleration, rotation and in some arrangements changes in magnetic fields during a putting stroke (step S10). The processor calculates the speed, position and orientation of the putter head at selective intervals during the putting stroke (step S11). If the sensor is connected to a robot arm as the input device 32 (YES in step S12), the data is stored in the sensor memory 22 (S13), and the learning process is complete.

If the sensor is not attached to a robot arm as the user input device (NO in step S12), the system waits for an indication from the user as to whether the putt was a successful putt (step S14). That is, in an exemplary embodiment, a successful putt is a putt that goes where the user intended such as in a hole at which the user was aiming. If the putt was successful (YES in step S14), the data is stored in the memory 22 (step S15), and the system determines whether additional data is needed to derive the user's preferred putting stroke (step S16). If not, the process is ended. If so, the process returns to step S10 to obtain measurement data from a subsequent putting stroke.

When using the robotic arm, the characteristics of the preferred putting stroke have already been established, and the robotic arm can be used to transfer the established preferred putting stroke to the sensor 10. Alternatively, if the sensor is being used to learn the user's preferred putting stroke based on multiple successful putts, numerous putts may be required for an accurate indication of the user's preferred putting stroke. In some embodiments, the processor then calculates the preferred putting stroke based on average characteristics of the plurality of successful putting strokes. Ideally, the processor can utilize 30-40 successful putts to provide the most accurate preferred putting stroke. Of course, the processor can calculate the average characteristics in as few as two successful putting strokes.

With the presently described sensor assembly and the patents identified and incorporated by reference above, a putting system may include tools and features to assist golfers in maximizing their putting skill potential. In one system described in the noted patents, built-in computers (e.g., iPads) supported in a putting grid record repeated putting strokes for various distances for each individual. As many strokes as necessary may be recorded to find an optimum preferred stroke for each golfer at various distances. For portability, the computer screens after recording the golfer's putting data, may be replaced with a plastic grid insert on which all of the information from the computer has been transferred. Distances for various putts with required stroke draw backs are also recorded on the grid insert. In use, the plastic grid can be removed from the teaching or training unit for use on a putting green.

Using the robotic arm, also described in the noted patents, each golfer's preferred strokes are recorded and may be transferred to the robotic arm structural configurations. For example, the robotic arm guide rail may be adjusted in three dimensions to match what was recorded by the computer. The guide rail may be adjusted infinitely to allow for changes in desired putting performance as putting skills progress. Other mechanisms such as guiding side walls and accommodations for putter type are adjusted for each golfer who has recorded a preferred putting stroke. The robotic arm is controlled by software or the like, and the speed of the club head and distance of the draw back, etc. are also adjusted for each golfer. After adjustments have been made on the robotic arm, the robotic arm can repeat the preferred putting stroke over and over with the same putts with a 98% degree of accuracy. In some embodiments, the robotic arm is accurate for putts up to 20 feet. Putting students using the robotic arm grasp the putter handle for the selected putt, and the robotic arm will guide the golfer to repeat the preferred putting stroke, thereby teaching the golfer muscle memory for each stroke.

Various speeds of the strokes and the time required to perform the putt may be calculated by the system software, e.g., it may be more desirable to have a shorter draw back but with more speed to accomplish a longer distance putt. This is also unique to each golfer and is a characteristic of the determined preferred putting stroke.

Aiming the robotic arm is a useful tool for perfecting green reading. In use, the robotic arm is aimed by the golfer, and the golfer must make judgments to adjust aim for straight or breaking putts. The consistency of the robotic arm stroke eliminates erratic strokes. As such, the error of a missed putt using the robotic arm is in aiming the robotic arm. The initial set up of the arm for distance and direction is a test in green reading (as well as in placing the robotic arm). A failed putt using the robotic arm teaches a valuable lesson in faulty judgment of placement and/or green reading. Careful analysis of a failed putt at this point can be used to train and practice green reading skills.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A putting stroke sensor system including a putting stroke sensor attachable to a putter head, the system comprising:

a memory storing an executable program;

a processor configured to execute the program; and a motion sensor integrated circuit communicating with the processor, the motion sensor integrated circuit being configured to measure acceleration of the putter head along X, Y and Z axes and rotation of the putter head around the X, Y and Z axes during a putting stroke, the putting stroke being defined by intervals, wherein by executing the program, the processor is programmed to, based on the measured acceleration, calculate, using mathematical formulae including calculus principles and polynomial regression, a speed and a position of the putter head at selective ones of the intervals during the putting stroke, and the processor is programmed to determine the rotation of the putter head at selective ones of the intervals during the putting stroke based on the measured rotation of the putter head around the X, Y and Z axes.

2. A putting stroke sensor system according to claim 1, wherein the processor is programmed to compare the speed, the position and the orientation of the putter head at the selective intervals during the putting stroke with corresponding characteristics at corresponding intervals of a preferred putting stroke.

3. A putting stroke sensor system according to claim 2, further comprising feedback LEDs that are driven by the processor to display deviations in the position, speed and/or rotation with the corresponding characteristics of the preferred putting stroke.

4. A putting stroke sensor system according to claim 1, further comprising a wireless transmission integrated circuit that is configured to communicate the measured acceleration and rotation to a mobile device.

5. A putting stroke sensor system according to claim 4, wherein the mobile device stores a mobile application, and wherein the processor is resident in the mobile device.

6. A putting stroke sensor system according to claim 1, wherein the motion sensor integrated circuit is further configured to measure changes in magnetic fields on at least two axes relative to Earth.

7. A putting stroke sensor system according to claim 6, wherein the motion sensor integrated circuit comprises a 2-axis magnetometer.

8. A putting stroke sensor system according to claim 1, wherein the processor is programmed to operate in a learning mode upon execution of the program, wherein in the learning mode, the processor is programmed to store the speed, the position and the orientation of the putter head at the selective intervals during a successful putting stroke.

9. A putting stroke sensor system according to claim 8, further comprising a user input device that is actuated to signify the successful putting stroke.

10. A putting stroke sensor system according to claim 9, wherein the processor is programmed to collect the speed, the position and the orientation of the putter head at the selective intervals for a plurality of the successful putting strokes, and wherein the processor is programmed to calculate a preferred putting stroke based on average characteristics of the plurality of successful putting strokes.

11. A putting stroke sensor system according to claim 9, wherein the user input device comprises one of a user-operated switch and a robotic putting arm, wherein the processor is programmed to calculate the preferred putting stroke differently depending on the user input device.

12. A putting stroke sensor system according to claim 8, further comprising a user input device including a robotic putting arm.

13. A putting stroke sensor system including a putting stroke sensor attachable to a putter head, the sensor comprising:

a memory storing an executable program;

a processor configured to execute the program; and a motion sensor integrated circuit communicating with the processor, the motion sensor integrated circuit including an accelerometer configured to measure acceleration of the putter head along X, Y and Z axes during a putting stroke and a gyroscope configured to measure rotation of the putter head around the X, Y and Z axes during the putting stroke, wherein by executing the program, the processor is programmed to, based on the measured acceleration, calculate, using mathematical formulae including calculus principles and polynomial regression, a speed and a position of the putter head at selective intervals during the putting stroke, and the processor is programmed to determine the rotation of the putter head at selective ones of the intervals during the putting stroke based on the measured rotation of the putter head around the X, Y and Z axes, wherein the processor is programmed to compare the speed, the position and the orientation of the putter head at the selective intervals during the putting stroke with corresponding characteristics at corresponding intervals of a preferred putting stroke, wherein the processor is programmed to display deviations in the position, speed and/or rotation with the corresponding characteristics of the preferred putting stroke, wherein the processor is programmed to operate in a learning mode upon execution of the program, and wherein in the learning mode, the processor stores the speed, the position and the orientation of the putter head at the selective intervals during a successful putting stroke, the system further comprising a user input device that is actuated to signify the successful putting stroke, wherein the user input device comprises one of a user-operated switch and a robotic putting arm, wherein the processor is programmed to calculate the preferred putting stroke differently depending on the user input device.

14. A putting stroke sensor system according to claim 13, further comprising feedback LEDs that are driven by the processor to display the deviations in the position, speed and/or rotation with the corresponding characteristics of the preferred putting stroke.

15. A putting stroke sensor system according to claim 13, wherein the processor is programmed to collect the speed, the position and the orientation of the putter head at the selective intervals for a plurality of the successful putting strokes, and wherein the processor is programmed to calculate a preferred putting stroke based on average characteristics of the plurality of successful putting strokes.

16. A putting training method using a putting stroke sensor attached to a putter head, the method comprising:

(a) measuring, with a motion sensor, acceleration of the putter head along at least two axes and rotation of the putter head around the at least two axes during a putting stroke, the putting stroke being defined by intervals;

(b) calculating, by a processor, based on the measured acceleration, using mathematical formulae including calculus principles and polynomial regression, a speed and a position of the putter head at selective ones of the intervals during the putting stroke;

(c) determining, by the processor, a rotation of the putter head at selective ones of the intervals during the putting stroke based on the measured rotation of the putter head around the at least two axes; and (d) comparing, by the processor, the speed, the position, and the rotation of the putter head at the selective intervals during the putting stroke with corresponding characteristics at corresponding intervals of a preferred putting stroke.

17. A method according to claim 16, wherein in a learning mode, the method further comprises storing the speed, the position, and the rotation of the putter head at the selective intervals during a successful putting stroke.

18. A method according to claim 17, comprising, prior to step (a), collecting the speed, the position, and the rotation of the putter head at the selective intervals for a plurality of the successful putting strokes, and calculating the preferred putting stroke based on average characteristics of the plurality of successful putting strokes.

19. A method according to claim 17, further comprising securing the putting stroke sensor to a robotic putting arm, and storing the speed, the position, and the rotation of the putter head at the selective intervals of the preferred putting stroke.

* * * * *